US008887614B1

(12) United States Patent
Carreiro

(10) Patent No.: US 8,887,614 B1
(45) Date of Patent: Nov. 18, 2014

(54) STACKED BUOYANT PAYLOAD LAUNCHER

(71) Applicant: Paul J. Carreiro, Swansea, MA (US)

(72) Inventor: Paul J. Carreiro, Swansea, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 78 days.

(21) Appl. No.: 13/893,487

(22) Filed: May 14, 2013

(51) Int. Cl.
*F41F 3/00* (2006.01)
*B63G 8/30* (2006.01)

(52) U.S. Cl.
CPC ..... *B63G 8/30* (2013.01)
USPC ..... 89/1.809; 89/1.81

(58) Field of Classification Search
CPC ..... B63G 8/30
USPC ..... 89/1.809, 1.81, 1.819, 1.806, 1.8
See application file for complete search history.

(56) References Cited

U.S. PATENT DOCUMENTS 3,373,657 A * 3/1968 Guin ..... 89/1.81
3,481,246 A * 12/1969 Snyder ..... 89/1.51
3,499,364 A * 3/1970 Ooge ..... 89/1.81
4,185,538 A * 1/1980 Barakauskas ..... 89/1.81
4,572,463 A * 2/1986 Ashkenazi ..... 244/3.3
4,665,791 A * 5/1987 Bugiel ..... 89/1.1
5,003,909 A * 4/1991 Moody ..... 114/238
5,094,140 A * 3/1992 Williams ..... 89/1.819
5,370,033 A * 12/1994 Bitsakis et al. ..... 89/1.81
5,419,232 A * 5/1995 Curtis ..... 89/1.81
5,438,905 A * 8/1995 Matheson et al. ..... 89/1.816
7,128,013 B1 * 10/2006 Plunkett et al. ..... 114/238
7,243,609 B1 * 7/2007 Ansay et al. ..... 114/316
7,340,986 B1 * 3/2008 Gaigler ..... 89/1.806
7,418,914 B2 * 9/2008 Ansay et al. ..... 114/239
7,665,395 B2 * 2/2010 Kim et al. ..... 89/1.816
7,997,224 B2 * 8/2011 Owen et al. ..... 114/238
2007/0006721 A1 * 1/2007 Herbage ..... 89/1.8

* cited by examiner

*Primary Examiner* — Michelle R Clement
(74) *Attorney, Agent, or Firm* — James M. Kasischke; Michael P. Stanley

(57) ABSTRACT

A submarine buoyant payload launcher system includes support rails extending longitudinally along an interior surface of a submarine missile capsule. A plurality of hold downs are spaced along the length of each rail and are retractable into the support rails. Once a payload is in position within the rails, the hold downs adjacent to the top end of the payload are rotated to their closed position, so as to contact the payload. Another payload can then be loaded within the rails until the payload contacts with the closed hold downs. As in the case of the first payload, the hold downs adjacent to the top end of this next payload are rotated to their closed position. Multiple payloads can be loaded within the rails in this manner.

13 Claims, 4 Drawing Sheets

STACKED BUOYANT PAYLOAD LAUNCHER

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention relates to underwater launching of payloads, and more particularly to stowing and launching of multiple buoyant payloads using existing submarine vertical missile tubes and capsule interfaces.

(2) Description of the Prior Art

Traditionally, submarine vertical payload tubes have been reserved for undersea launched missiles. Underwater deployment of smaller payloads has been limited to ejection from torpedo tubes, the trash disposal unit, the signal ejector, or through the escape hatch lockout trunk. Each of these deployment methods has disadvantages.

Torpedo tubes are generally horizontal. Thus, payloads must be fired from the tubes by using compressed air. Accordingly, payloads need to be fortified to withstand the launching pressures of compressed air. Also, the compressed air blast makes a surreptitious payload launch practically unachievable. While a trash disposal unit does not require a compressed air blast to eject a payload, the disposal unit is configured to drop compacted trash payloads to the ocean floor. Thus, the use of buoyant payloads is generally precluded.

A typical signal ejector tube can accommodate payloads approximately three inches in diameter. Thus, payload size is extremely limited. The escape hatch lockout trunk can accommodate a man sized payload. However, the payload would need to be fitted within the hatch cowling, or hand released by a diver within the flooded hatch. Such a configuration would allow for only a single payload per launch.

What is needed is a system for launching a buoyant payload from a submarine that does not require a compressed air blast for launch. The payload should be launched towards the surface and the launch system should accommodate payload diameters greater than three inches. Additionally, the system should be capable of launching multiple payloads without the need for hands on loading.

SUMMARY OF THE INVENTION

Accordingly, it is a primary purpose and general object of the present invention to provide a submarine launch system for a buoyant payload.

It is a further object of the present invention to provide a system for launching a buoyant payload from a submarine that does not require a compressed air blast for launch.

It is a still further object of the present invention to provide a submarine launch system wherein the payload is launched towards the surface and the launch system accommodates payload diameters greater than three inches.

It is a still further object of the present invention to provide a submarine launch system capable of loading and launching multiple payloads.

In accordance with these and other objects made apparent hereinafter, a submarine buoyant payload launcher system is provided. The system is configured to fit the interior of a submarine missile capsule, which is then loaded into one of the vertical missile tubes of the submarine. By being outfitted within the missile capsule, the system makes use of existing mechanical and electrical capsule interfaces of the missile tube, as well as the loading, handling and special support equipment of the capsule.

The system includes support rails that extend longitudinally along the interior surface of a capsule. Payloads are configured to fit within the space bound by the rails and to be stacked within the support rails. A plurality of hold downs are spaced along the length of each rail. In an open position, the hold downs are retracted into the support rails and do not protrude into the space occupied by the payloads. With the hold downs in their open position, a payload can be loaded within the rails.

Once a payload is in position within the rails, the hold downs adjacent to the top end of the payload are rotated to their closed position in order to contact the payload. A boss on the hold down fits into a detent in the top of the payload. Another payload can then be loaded within the rails until the payload contacts the closed hold downs. A shelf in the top of each hold down mates with a corresponding cutout on the bottom of the payload. As in the case of the first payload, the hold downs adjacent to the top end of this next payload are rotated to a closed position. Multiple payloads can be loaded within the rails in this manner.

Other objects, features and advantages of the present invention including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent, wherein corresponding reference characters indicate corresponding parts throughout the several views of the drawings and wherein.

DETAILED DESCRIPTION OF THE INVENTION

Figure 1:
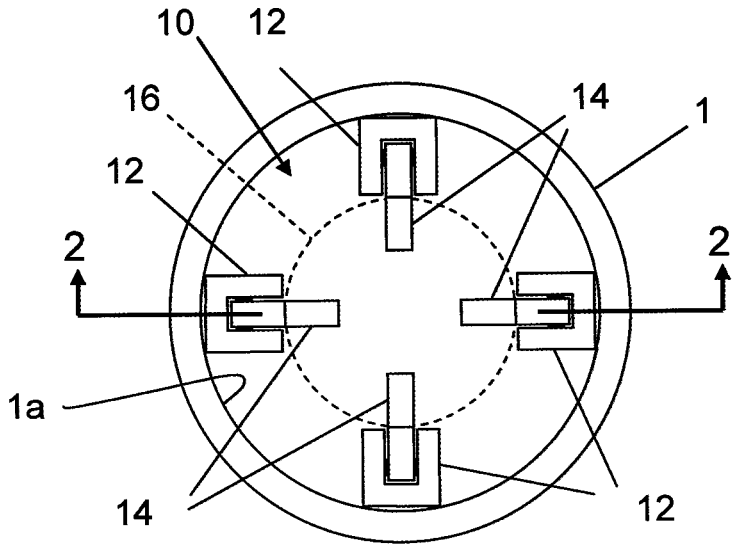
FIG. 1 is a top view of a buoyant payload launcher system of the present invention.

Referring now to FIG. 1, there is shown a top view of a launcher system 10 configured to fit within an existing submarine missile capsule 1. Support rails 12 of the launcher system 10 are equally spaced about interior surface 1*a* of the capsule 1. As described further hereinafter, hold downs 14 are rotatably mounted within the support rails 12 and secure payload 16 (illustrated in phantom in FIG. 1) within the support rails. As shown in FIG. 1, the payload 16 is configured and sized such that there is clearance between the rails 12 and the payload; thereby, allowing insertion of the payload into the system 10.

Figure 2:
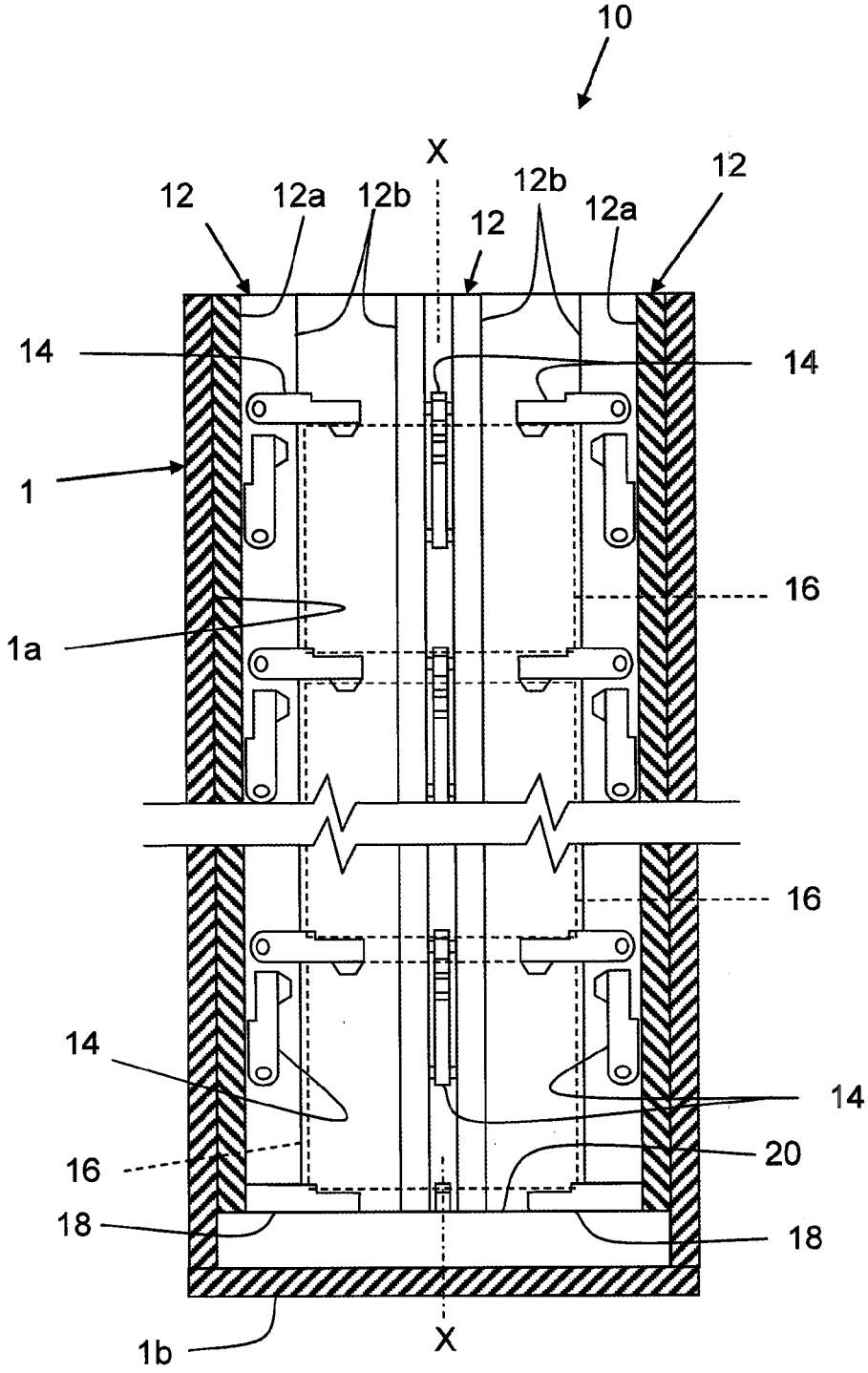
FIG. 2 is a cross sectional view taken at reference line 2-2 in FIG. 1.

Referring to FIG. 2, there is shown a cross sectional view of the launcher system 10, taken at reference line 2-2 of FIG. 1. As described with respect to FIG. 1, the support rails 12 are equally spaced within capsule 1. For illustration of the embodiment shown in FIGS. 1 and 2, but not for limitation, the support rails 12 are configured in a channel shape. Web portions 12*a* of the support rails 12 are mounted to the interior surface la of capsule 1 and flanges 12*b* extend towards center axis X-X of the capsule. The rails 12 extend longitudinally along the length of cylindrical capsule 1.

The hold downs 14 are spaced along the length of each rail 12. For clarity of illustration, cross-hatching of the hold downs 14 is omitted. As described with respect to FIG. 1, the hold downs 14 are rotatably mounted between the flanges 12*b* of the rails 12. In FIG. 2, three sets of hold downs 14 are illustrated in a closed position, including the top most set of the hold downs also illustrated in FIG. 1. Also in FIG. 2, three other sets of hold downs 14 are illustrated in the open position, including the lowermost hold downs. For clarity of illustration, reference numerals designate only the topmost and lowermost sets of the hold downs 14.

In the open position, the hold downs 14 are aligned with longitudinal axis X-X of the capsule 1. Also in the open position, the hold downs 14 lie adjacent to the webs 12*a* and between the flanges 12*b* of the rails 12. With the hold downs 14 in this position; the payloads 16 (also shown in phantom in FIG. 2) can be inserted into the system 10 without interference from the hold downs 14 until coming into contact with lower supports 18.

Once the payload 16 is secured against the lower supports 18; the hold downs 14 immediately above the inserted payload 16 can be rotated 90 degrees to the closed position so as to contact the payload. Another payload 16 can be inserted into the system 10 until coming into contact with the hold downs 14 in the closed position. Again, the hold downs 14 immediately above the inserted payload 16 can be rotated 90 degrees to the closed position. Further payloads 16 can be similarly loaded.

Figure 3:
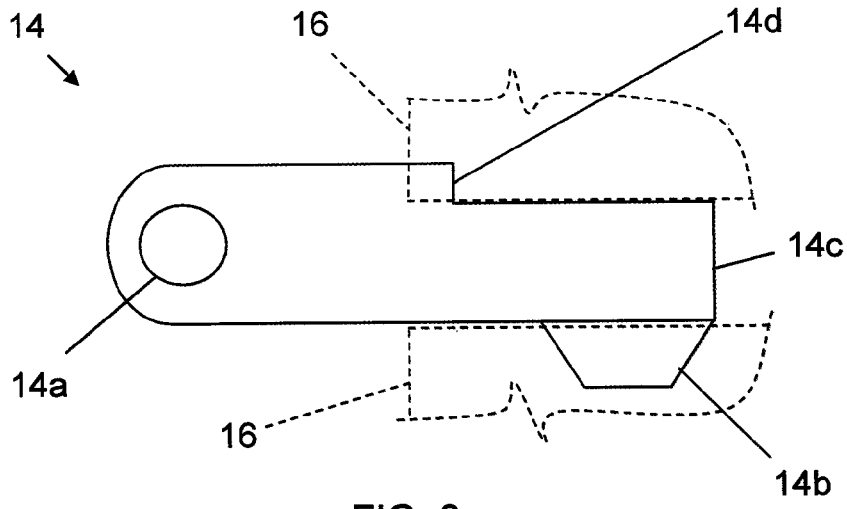
FIG. 3 is front view of a hold down at a scale larger than shown in FIG. 2.

Referring to FIG. 3, there is shown a larger scale front view of a hold down 14. As described previously herein, the hold down 14 is rotatably connected between the flanges 12*b* of the rails 12 via actuator pin 14*a*. Rotation of the actuator pin 14*a* is controlled by control unit 20 of the system 10 (shown in FIG. 2). The control unit 20 is configured to connect with the existing mechanical and electrical interfaces 1*b* of capsule 1.

The hold down 14 includes boss 14*b* extending (downward in the orientation of FIG. 3) from arm portion 14*c* of the hold down 14. Additionally, shelf 14*d* is opposed to the boss 14*b* on the arm portion 14*c*.

Figure 4:
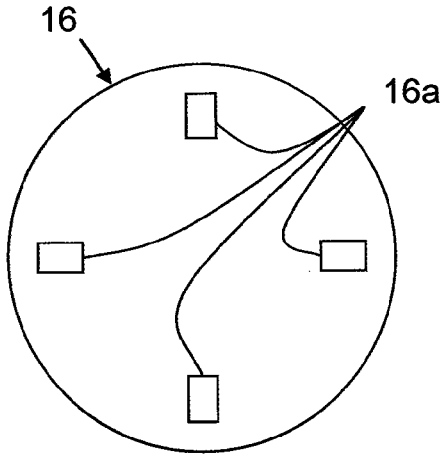
FIG. 4 is a top view of a buoyant payload.
Figure 5:
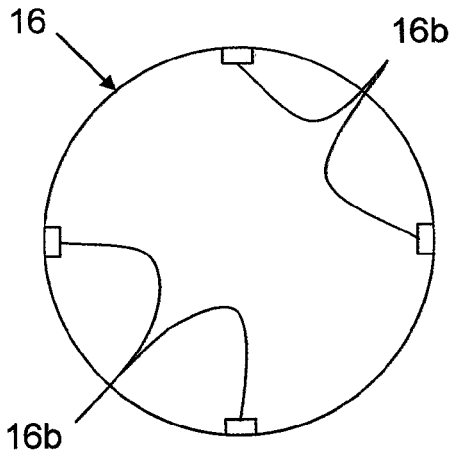
FIG. 5 is a bottom view of a buoyant payload.

Referring also to FIGS. 4 and 5, there are shown respective top and bottom views of a payload 16. The boss 14*b* mates with detents 16*a*, shown in top view (FIG. 4) of the payload 16. Cutouts 16*b*, shown in bottom view (FIG. 5) of the payload 16 mate with the shelf 14*d*. The cutouts 16*b* also mate with the lower supports 18 (shown in FIG. 2). Portions of two payloads 16 are shown in phantom in FIG. 3 to illustrate the mating of payloads 16 with the boss 14*b* and the shelf 14*d*.

Once the payloads 16 have been inserted into the system 10; the missile capsule 1 can be loaded into its missile tube using existing capsule loading equipment. To deploy the payloads 16, the missile tube muzzle is exposed to the sea and the interior space within the capsule 1 is free flooded. A signal is provided to the control unit 20 (via the interfaces 1*b*) to rotate the hold downs 14 that are mated with the detents 16*a* of the uppermost payload 16 from a closed to open position. At this point, the buoyant payload 16 is free to float out of the system 10 and away from the missile tube. Any additional payloads 16 can be similarly released.

What has thus been described is a buoyant payload launcher system 10 that fits within an existing submarine missile capsule 1. The capsule 1 containing the system 10 can be loaded into a submarine missile tube using the existing capsule loading equipment. The system control unit 20 connects with the existing capsule and missile tube interfaces 1*b* such that payload launch signals can be communicated to the system 10.

As the missile tube is merely flooded and the payloads 16 can float away from the submarine, no compressed air blast is needed for launch. The system 10 provides for launching payloads 16 having a greater diameter than can be launched from the signal ejector tube. Additionally, the system 10 can launch multiple payloads during one launch sequence, or can provide multiple launches at differing times.

The system 10 includes support rails 12 extending longitudinally along the interior surface the missile capsule 1. A plurality of hold downs 14 are spaced along the length of each rail 12 and are retracted into the support rails 12. Once a payload 16 is in position within the rails 12, the hold downs 14 adjacent the top end of the payload are rotated to their closed position, so as to contact the payload. By having a plurality of hold downs 14 spaced along the rails 12, the system 10 is able to accommodate payloads 16 having a variety of lengths.

Another payload 16 can then be loaded within the rails 12) until it comes into contact with closed hold downs 14. As in the case of a first payload 16, the hold downs 14 adjacent the top end of this next payload 16 are then rotated to their closed position. Multiple payloads 16 can be loaded within the rails 12 in this manner.

The foregoing description of the preferred embodiments of the invention has been presented for purposes of illustration and description only. It is not intended to be exhaustive or to limit the invention to the precise form disclosed; and obviously many modifications and variations are possible in light of the above teaching.

Figure 6:
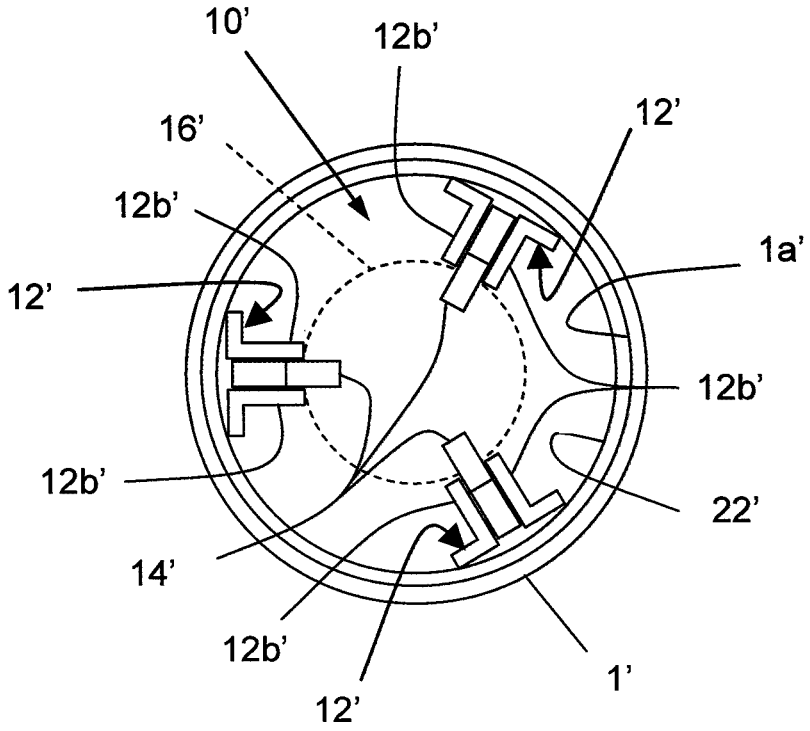
FIG. 6 is a top view of an alternate embodiment of a buoyant payload launcher system.

For example, FIG. 1 illustrates four rails 12 having a channel shape and spaced equally within the capsule 1. The number of rails 12 and their exact configuration and shape can be modified, with a minimum of three rails providing adequate lateral support for the payloads 16, and providing for rotatably mounting the hold downs 14 thereto. FIG. 6 shows a top view of an alternate embodiment of system 10', wherein the four support rails 12 of FIG. 1 are replaced with three sets of rails 12' configured in back to back angle shapes mounted within capsule 1'. Hold downs 14' are rotatably mounted between flanges 12*b'* of the rails 12'. As in FIG. 1, the hold downs 14' secure payload 16' between the support rails 12'.

Also, the system 10 is described herein as being mounted to inner surface 1*a* of missile capsule 1. Alternatively, the system 10' can be self-supporting by providing supports between the rails 12' independent from surface 1*a'*, such as by one or more ring supports 22' shown in FIG. 6. In this manner, the system 10' can be removed from the capsule 1' for maintenance or replacement as necessary.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A buoyant payload launcher system deployable within a missile capsule, said system comprising:

a set of rails spaced about an interior surface of said capsule and extending longitudinally within said capsule;

at least one buoyant payload sized to fit within a space bound by said set of rails and to maintain a clearance between said rails and said payload; and at least one set of hold downs, each one hold down of said set of hold downs being rotatably mounted to one rail of said set of rails, said each one hold down being contained within said one rail in an open position, said each one hold down extending from said one rail in a closed position, said each one hold down in said closed position contacting said at least one payload to secure said payload between said rails.

2. The system of claim 1, wherein each said one rail further comprises:

a web portion adjacent to an interior surface of said capsule; and a flange portion extending from said flange portion in a direction toward a central axis of said capsule, said each one hold down being mounted to said flange portion, said each one hold down extending no further towards said central axis than said flange when in said open position.

3. The system of claim 2, further comprising:

a boss extending from said each one hold down; and a set of detents on an upper surface of said payload, said boss of said each one hold down of said set of hold downs mating with one detent of said set of detents when said set of hold downs is in said closed position.

4. The system of claim 3, further comprising:

a shelf disposed opposite from said boss on said each one hold down; and a set of cutouts on a lower surface of said at least one payload, said shelf of said each one hold down of said set of hold downs mating with one cutout of said set of cutouts when said at least one payload is positioned above said set of hold downs in said closed position.

5. The system of claim 4, further comprising a set of lower supports positioned at a base of said rails, each one of said lower supports mating with one cutout of said set of cutouts when said at least one payload is positioned above said set of lower supports.

6. A buoyant payload launcher system deployed within a missile capsule, said system comprising:

at least three rails spaced about an interior surface of said capsule and extending longitudinally within said capsule;

a set of hold downs rotatably mounted to each rail of said rails, said hold downs of each said set being spaced equally along said each rail, each said set of hold downs being equally spaced longitudinally within said capsule; and a control unit connected to an interface of said capsule, signals from said control unit operating to rotate said each of said hold downs between a closed position and an open position, wherein said each of said hold downs extends radially from said each rail towards a central axis of said capsule in said closed position.

7. The system of claim 6, wherein said each rail comprises a channel, said each of said hold downs being mounted between flange portions of said channel.

8. The system of claim 6, wherein said each rail comprises a pair of angles, said each of said hold downs being mounted between a flange portion of a first angle of said pair of angles and a flange portion of a second angle of said pair of angles.

9. The system of claim 6, further comprising at least one buoyant payload sized to fit within a space bounded by said rails, said each of said hold downs being withdrawn from said space when in said open position, said each of said hold downs contacting said payload when in said closed position.

10. The system of claim 9, further comprising:

a boss extending from said each of said hold downs; and a set of detents on an upper surface of said payload, said boss of said each of said hold downs mating with one detent of said set of detents when said each of said hold downs is in said closed position.

11. The system of claim 10, further comprising:

a shelf disposed opposite from said boss on said each of said hold downs; and a set of cutouts on a lower surface of said at least one payload, said shelf of said each of said hold downs mating with one cutout of said set of cutouts when said at least one payload is positioned above said each of said hold downs in said closed position.

12. The system of claim 11, further comprising a set of lower supports positioned at a base of said rails, each one of said lower supports mating with one cutout of said set of cutouts when said at least one payload is positioned above said set of lower supports.

13. The system of claim 12, further comprising rail supports spanning between said rails, said rails being attached to said rail supports, said rail supports configured to fit between said rails and said interior surface of said capsule.

* * * * *